US006379259B1

(12) United States Patent
Opie

(10) Patent No.: US 6,379,259 B1
(45) Date of Patent: Apr. 30, 2002

(54) GOLF PUTTER

(76) Inventor: Edward C. Opie, 5155 Tahoe Ct., Carkston, MI (US) 48348

( * ) Notice: Subject to any disclaimer, the term of this patent is extended or adjusted under 35 U.S.C. 154(b) by 0 days.

(21) Appl. No.: 09/666,589

(22) Filed: Sep. 20, 2000

(51) Int. Cl.[7] ..... A63B 69/36; A63B 53/04; A63B 47/02

(52) U.S. Cl. ..... 473/251; 473/254; 473/286; 473/249; 473/340; 294/19.2

(58) Field of Search ..... 473/340, 341, 473/286, 251, 252, 253, 254, 255, 256, 350, 349, 313, 292, 249, 327, 328; 294/19.2; D21/736–746

(56) References Cited

U.S. PATENT DOCUMENTS

| | | | | |
|---|---|---|---|---|
| 1,756,219 | A | * | 4/1930 | Spiker |
| 3,779,398 | A | * | 12/1973 | Hunter |
| D246,329 | S | | 11/1977 | Little |
| 4,136,877 | A | * | 1/1979 | Antonious |
| 4,325,553 | A | * | 4/1982 | Taylor |
| 4,508,350 | A | * | 4/1985 | Duclos |
| 4,522,405 | A | | 6/1985 | Clawges |
| D296,120 | S | | 6/1988 | Brace |
| D306,629 | S | | 3/1990 | Shearer |
| D310,115 | S | | 8/1990 | Iinuma |
| 4,962,927 | A | | 10/1990 | Colucci |
| D314,031 | S | | 1/1991 | Iinuma |
| 5,167,414 | A | * | 12/1992 | Montgomery |
| 5,211,401 | A | | 5/1993 | Hainey |
| 5,340,106 | A | * | 8/1994 | Ravaris |
| 5,344,149 | A | * | 9/1994 | Miller |
| D356,613 | S | | 3/1995 | Adams et al. |
| 5,692,968 | A | | 12/1997 | Shine |
| 5,749,791 | A | | 5/1998 | Passeri, Jr. |
| 5,916,035 | A | * | 6/1999 | Caiozzo |
| 5,921,868 | A | * | 7/1999 | Dimartino |
| D412,729 | S | | 8/1999 | Woodward |
| 5,938,538 | A | | 8/1999 | Broadbridge et al. |
| 6,045,453 | A | | 4/2000 | Jenkins |
| D441,041 | S | * | 4/2001 | Opie |

* cited by examiner

*Primary Examiner*—Sebastiano Passaniti
(74) *Attorney, Agent, or Firm*—Welsh & Flaxman LLC

(57) ABSTRACT

A putter type golf club head including a heel, toe, ball striking face, upper surface, bottom sole surface and slotted rear portion, including a lower, rearwardly extending flange; and an upper, rearwardly extending flange. The mass of the upper flange is substantially greater than the mass of the lower flange, whereby the club head's center of mass is located toward the upper surface. The upper and lower flanges are formed by a longitudinal slot extending in a heel to toe direction. The upper flange is formed with a semi-circular opening centrally located behind the ball striking face and midway between and separating the heel and toe. The bottom sole of the club head is provided with a bounce angle which raises the leading edge above the putting surface to eliminate scuffing of the club head on the ground during the execution of a putting stroke. The semi-circular opening cooperates with a semi-circular recess on the lower flange to provide a bull's eye, semi-circular type target to aid a golfer to strike a golf ball in the center of the club head and to act as a golf ball pick-up structure.

7 Claims, 3 Drawing Sheets

GOLF PUTTER

BACKGROUND OF THE INVENTION

The present invention relates to golf putters and more particularly to a golf club putter having a combination of performance enhancing features.

Prior art putters are well known which incorporate various features to enhance the performance of the golf club. For example, U.S. Pat. No. 5,211,401 to Haney shows a putter type golf club with a raised mass which is concentrated about a horizontal plane through the center of the ball. U.S. Pat. No. 5,938,538 to Broadbridge shows a heel/toe weighted golf putter having a rearward extending flange on top of the putter head to raise the center of gravity of the putter head to a point opposite where the golf ball is impacted.

U.S. Pat. No. 4,522,405 to Clawges shows a golf putter having a bounce angle on the sole to prevent scuffing of the leading edge during the execution of a putting stroke.

U.S. Pat. No. 5,749,791 to Passeri shows a golf putter having an arcuate aperture, the size of a golf ball, directly behind the ball striking face for alignment purposes. U.S. Design Pat. No. 356,613 to Adams et al. shows a heel/toe weighted putter having an arcuate rear cavity centrally located behind the ball striking face.

U.S. Pat. No. 3,777,398 to Hunter shows another golf putter with a semi-circular recess behind the ball striking face, both for alignment purposes and for retrieving golf balls.

SUMMARY OF THE INVENTION

The present invention is directed to a putter type golf club head with a variety of features representing an improvement over the known prior art. The golf club head of the present invention includes a club head body and a hosel with a shaft socket for connection to a conventional golf shaft and handle. The club head includes a ball striking face, a heel, toe, upper surface, bottom sole and rear. The rear portion of the club head is defined by an arcuate slot extending in a heel to toe, longitudinal direction, formed between rearwardly extending, upper and lower flanges, the outer surfaces of which define the upper surface and bottom sole of the club head. The upper flange is thicker and has more mass than the lower flange, whereby a preponderance of weight of the club head body is located in the upper flange. The upper flange of the putter head is formed with a semi-circular opening having a diameter just slightly larger than the outside diameter a golf ball. The semi-circular opening separates the upper flange into a heel portion and a toe portion. The semi-circular opening and arcuate, longitudinal slot at the rear portion of the club head cooperate to raise the overall weight of the club head upwardly and toward the heel and toe portions of the club head, providing the putter head with an upper, heel/toe weighting configuration. Because the overall weight of the club head is located in the upper flange, the center of mass of the club head is in alignment with the center of a golf ball when both the putter head and the golf ball are on the same supporting surface, thereby providing a more efficient transfer of force to the golf ball during the execution of a putting stroke.

The inner surface of the lower flange includes a small, semi-circular recess which is positioned midway between edges of the upper semi-circular opening when viewed from above by a golfer with the putter in a normal address position. This semi-circular recess, in combination with the semi-circular opening, simulates a bull's eye, concentric circle type target alignment device. When viewed from above, and with the putter head in the proper position just before the execution of a putting stroke, the target alignment device facilitates aiming of the putter head to an intended target.

The bottom sole of the putter head is provided with a 9° bounce angle extending downwardly and rearwardly from the leading edge of the club head. The bounce angle prevents scuffing of the leading edge during forward movement of the putter head when executing a putting stroke.

The semi-circular recess on the lower flange and semi-circular cutout on the upper portion of the putter head also cooperate to facilitate using the club head to pick up a golf ball from the green or from the grass. Sliding the rear of the putter head under a golf ball so the ball rests in the recess and snugly fits within the upper semi-circular opening on the upper flange, allows the ball to be easily picked up by the golfer by maintaining a slight upward angle on the putter head as the ball is lifted.

In another embodiment of the club head, a ledge is provided at the heel portion of the upper flange at the point where the hosel is connected to the club head body. This removes weight from the heel portion in order to offset the weight of the hosel, thus keeping the overall heel-toe balance of the club head.

Another feature of the golf club head of the present invention is the overall balance of the club head which causes toe rollover to close the face of the club head when the club is placed upon a support surface. This rollover feature forces a golfer to place the putter on a proper aim line and requires the golfer to maintain it there rather than allowing the putter to sole itself.

Among the objects of the present invention are the provision of a golf putter having a heel/toe weighting configuration with a preponderance of mass located at the upper portion of the club head directly behind the center of a golf ball.

Another object of the present invention is the provision of a putter type golf club head having a target configuration directly behind the ball striking face to aid a golfer to strike the ball in the center of the club head.

Still another object of the present invention is the provision of a putter type golf club head which enables the golfer to pick up the ball from the green or grass.

Still another object of the present invention is a putter type golf club head having a positive bounce angle extending rearwardly from the leading edge to prevent scuffing of the leading edge of the putter on the forward stroke.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

Figure 1:
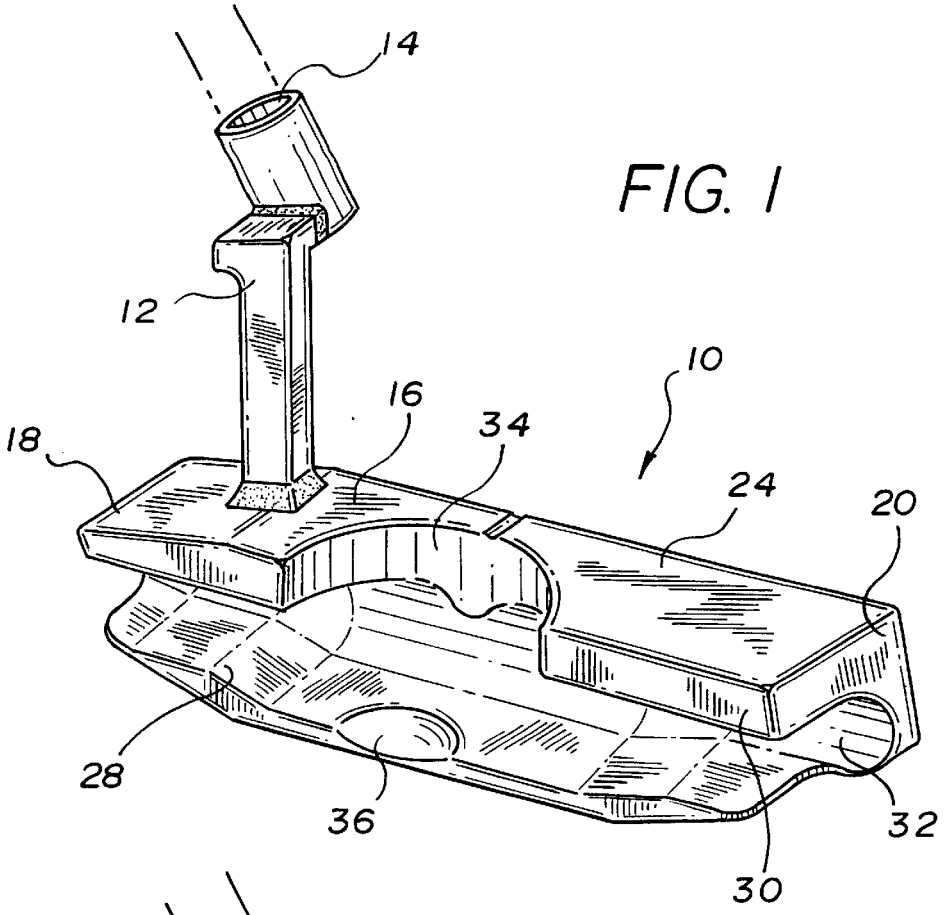
FIG. 1 shows a rear perspective view of a putter type golf club head in accordance with the present invention.
Figure 8:
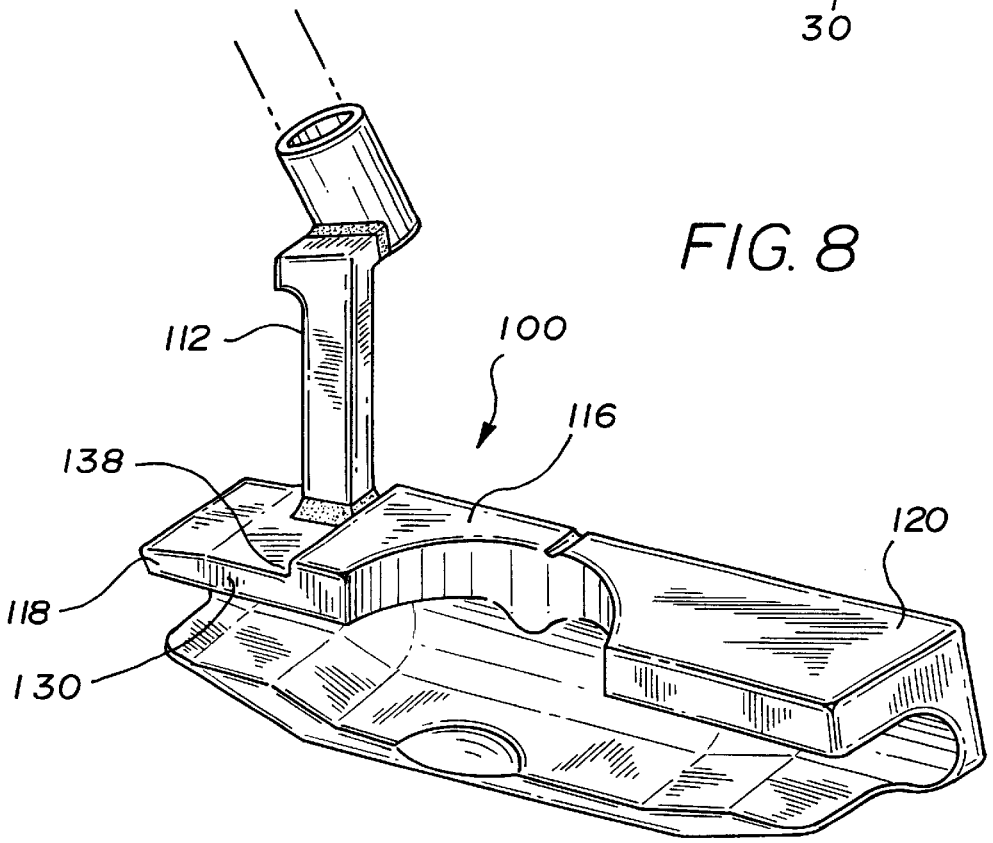
FIG. 8 is a rear elevational view of another embodiment of the present invention.
Figure 2:
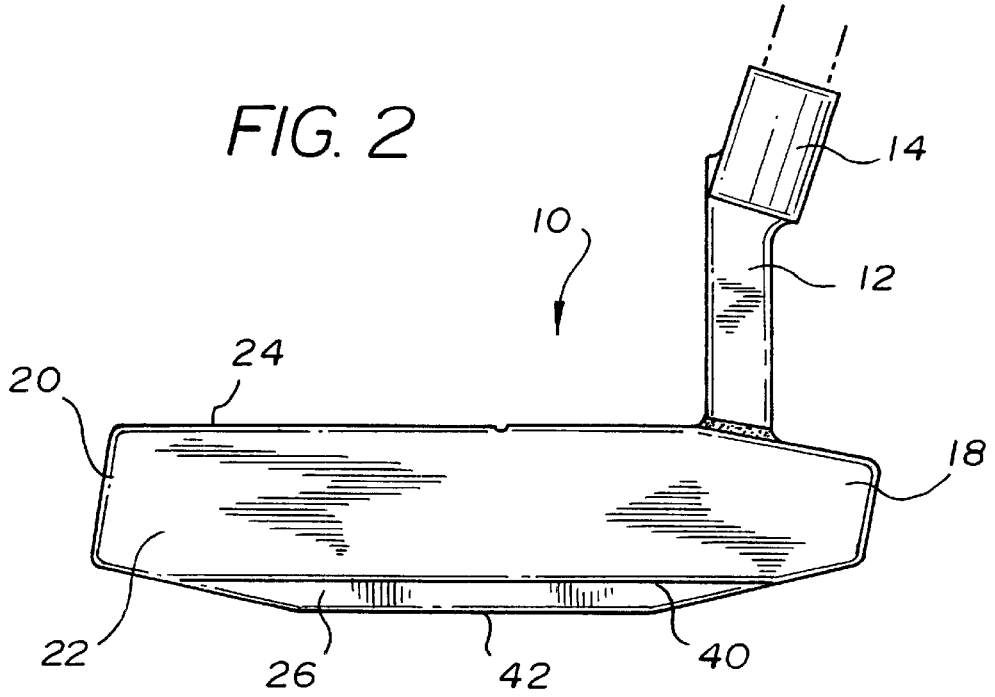
FIG. 2 is a rear elevational view thereof.
Figure 3:
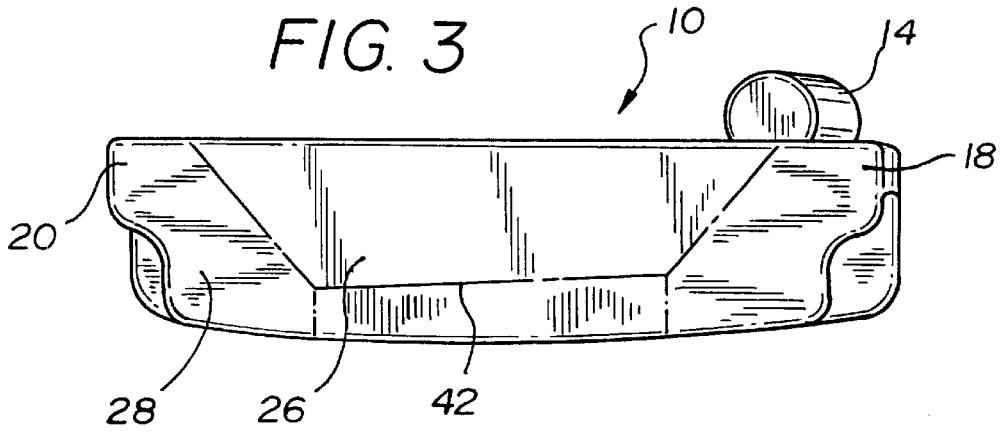
FIG. 3 is a bottom view thereof.
Figure 4:
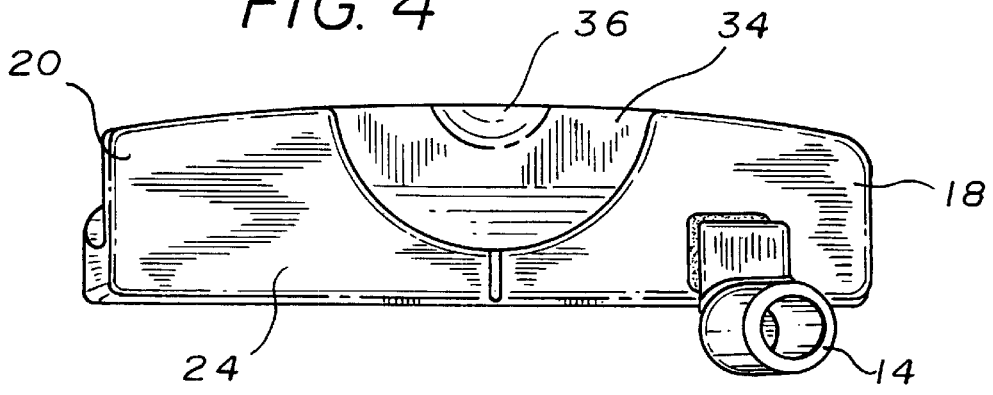
FIG. 4 is a top plan view thereof.
Figure 5:
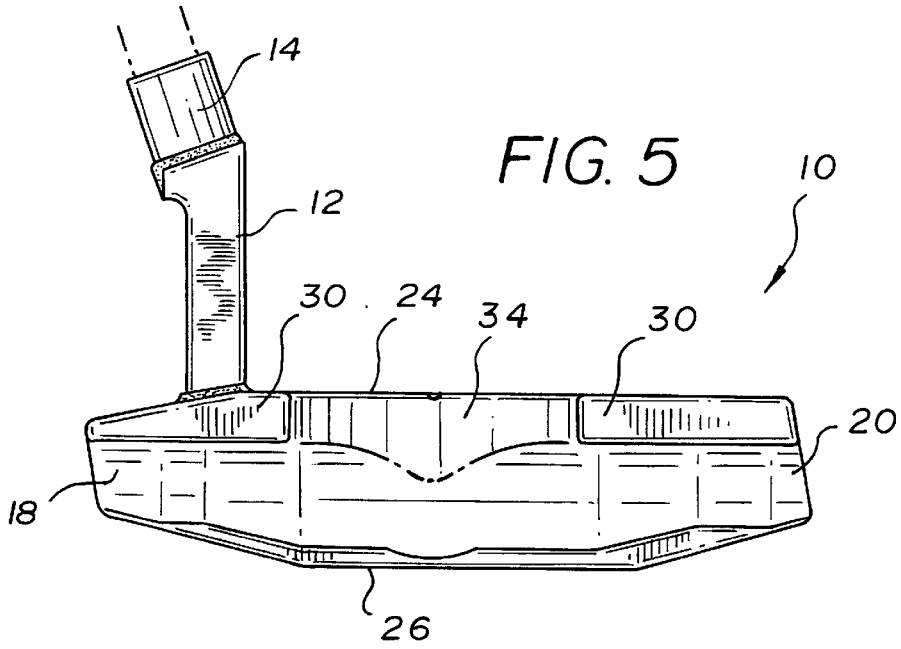
FIG. 5 is a rear elevational view thereof.
Figure 6:
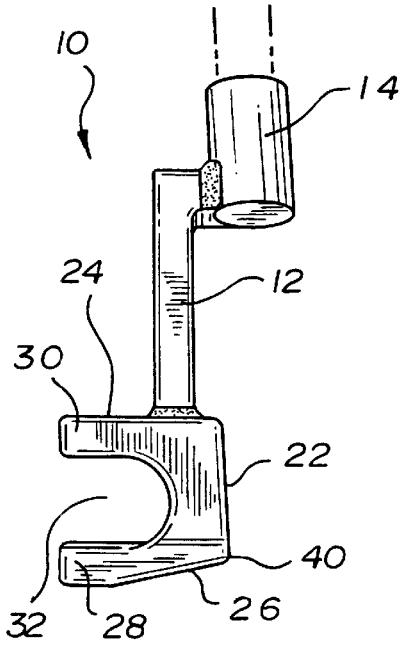
FIG. 6 is a toe end elevational view.
Figure 7:
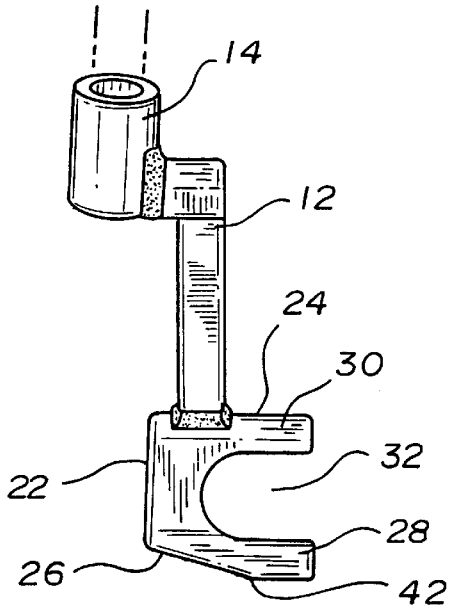
FIG. 7 is a heel end elevational view.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, a putter type golf club head 10 includes a hosel 12 with a shaft socket 14 and a club head body 16. The club head body 16 has a heel portion 18, toe portion 20, ball striking face 22, upper surface 24 and bottom sole surface 26. A rear portion 27 of the club head 10 is defined by a longitudinal, arcuate slot 32 extending in a heel to toe direction, formed between a rearwardly extending, lower flange 28 and an upper, rearwardly extending flange 30, the outer surfaces of which define the upper surface 24 and bottom sole 26 of the club head 10. The upper flange 30 is thicker and has more mass than the lower flange 28 whereby a preponderance of weight of the club head body 16 is raised upwardly. The upper flange 30 of the putter head 10 includes a semi-circular opening 34 having a diameter just slightly larger than the outside diameter a golf ball. Since there is no mass at the semi-circular opening 34,weight at the top of the club head 10 is separated into the heel portion 18 and the toe portion 20. Thus the combination of the semi-circular opening 34 and arcuate, longitudinal slot 32 at the rear of the club head 10 cooperate to raise the overall weight of the club head 10 upwardly and toward the heel portion 18 and toe portion 20 of the club head 10, providing the putter with an upper, heel/toe weighting configuration.

The inner surface 35 of the lower flange 28 includes a small, centrally located, semi-circular recess 36, which in combination with opening 34, when viewed from above with the putter head 10 in a proper address position on a support surface, simulates a bull's eye, concentric circle, type target, as shown in the upper plan view of the club head 10.

The bottom sole 26 of the club head 10 has 90° of bounce, similar to the bounce found on a sand wedge, which prevents scuffing of the leading edge 40 of the club head 10 during the execution of a putting stroke. The lowermost portion of the sole 26 is defined by a longitudinal edge 42 toward the rear and extending in a heel 18 to toe 20 direction. The longitudinal edge 42 forms a lowermost support when said club head 10 is positioned on a support surface and the overall weight of the club head body 16 causes it to angle forward with the toe rolling over and closing the face. This weight distribution requires a golfer to place the club head 10 on a pre-determined aim line and to hold it in that position as the stroke is executed, rather allowing the club head 10 to sole itself which would result in a closed ball striking face 22.

When viewing the putter head 10 of the present invention in a normal address position, prior to striking of the golf ball, the recess 36 and opening 34 align themselves to form a bull's eye type target of concentric semi-circles. This allows a golfer to visualize this target as an alignment aid in order to facilitate the ball hitting the center of the simulated target on the golf club head 10. The recess 36, in combination with the opening 34, also allows a golfer to pick up a golf ball either from the cup, the green or from the grass without having to bend over. The lower flange 28 of the club head 10 is slid under the ball allowing the ball to nestle in the recess 36 and snugly fit within the opening 34 allowing it to be picked up.

Preferably the opening 34 is approximately midway between the heel 18 and the toe 20 and is just slightly larger than the diameter of the ball whereby the opening 34 may be used to align with a golf ball prior to the execution of a putting stroke and to align the putter head 10 with the ball during the actual execution of the stroke.

Most modern golf club putter designs have the weight and the corresponding center of gravity nearer to the bottom of the club head, and this in turn, causes the golf ball to become slightly airborne above the putting surface, thereby being more adversely effected by imperfections on the putting surface. The semi-circular opening 34 and arcuate, longitudinal slot 32 at the rear of the club head 10 cooperate to raise the overall weight of the club head 10 upwardly and toward the heel portion 18 and toe portion 20 of the club head 10, providing the putter with an upper, heel/toe weighting. This results in a preponderance of the weight of the club head body 16 being located in the upper flange 30 which is in alignment with the center of a golf ball when both the putter head 10 and the golf ball are on the same support surface. This upper mass configuration in the upper flange 30 raises the center of gravity of the club head 10 which, in turn, causes the golf ball to roll lower, end over end, on the putting surface when struck by the club head 10 of the invention.

When a golfer sets the golf club 10 of the present invention behind a golf ball prior to the execution of a putting stroke, the opening 34, in combination with the semi-circular recess 36, may be used as an alignment device to position the club head 10 precisely behind the golf ball. When the semi-circular recess 36 is centrally aligned with the semi-circular edges of the opening 34 a bull's eye, concentric circle, type target appears providing a visual aid to ensure that the club head is in the proper orientation with respect to the support surface and the golf ball.

When the golfer executes a putting stroke, the weight of the upper flange 30 of the club head is concentrated directly behind the center of the golf ball causing it to roll immediately upon contact due to the alignment of the center of gravity of the club head 10 with the center of the ball.

During the execution of the stroke, the leading edge 40 of the club head 10 is raised above the putting surface because of the bounce angle whereby any contact made by the bottom sole 26 of the putter head 10 with the groung surface during this golf stroke will occur well behind the ball striking face 22 thereby virtually eliminating scuffing should a faulty stroke occur. Finally after the stroke is completed, and the ball is holed or lies close to the cup, the ball may be picked up by the putter head without having the golfer bend over simply by engaging the ball with the recess 36 and rear opening 34. The ball will stay within the opening 34 with just the slightest upward angular orientation of the putter head 10.

Another embodiment of a putter type golf club head 100 is essentially the same as the first embodiment described hereinabove except that the upper flange 130 is formed with a recessed ledge 138 at the heel portion 118 where the hosel 112 is connected to the club head body 116. The recessed ledge 138 removes weight from the club head body 116 in order to balance the weight of the hosel 112 and thus maintain an overall balance to the club head 100 in a heel 118 to toe 120 direction.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A putter type golf club head including a heel portion, toe portion, rear portion, ball striking face, upper surface and bottom sole wherein the improvement comprises: a longitudinal slot at said rear portion, extending in a heel to toe direction; said slot defining a lower, rearwardly extending flange and an upper, rearwardly extending flange; said upper rearwardly extending flange having a mass substantially greater than the mass of said lower, rearwardly extending flange; said upper flange having a semi-circular opening larger than the diameter of a golf ball centrally located thereon, between and separating said heel portion and said toe portion, whereby the center of mass of said club head is located toward said upper surface and said heel and toe portions of said club head.

2. The club head of claim 1 further including a 9 degree bounce angle on said bottom sole extending downwardly and rearwardly from a leading edge of said ball striking face; whereby said leading edge is raised above a putting surface when said club head is in position to execute a putting stroke.

3. The club head of claim 2 further including a longitudinal edge on said bottom sole toward the rear and extending in a heel to toe direction, said edge forming a lowermost club head support when said club head is positioned on a support surface.

4. The club head of claim 1 further including a recess on an inner surface of said lower flange; said recess cooperating with said upper flange opening to form a support means whereby a golfer may pick up a golf ball with said club head.

5. The club head of claim 4 wherein said recess cooperates with said semi-circular, upper flange opening to form a concentric semi-circular, bull's eye type target for alignment of a golf ball with said club head prior to the execution of a putting stroke.

6. The club head of claim 1 further including a semi-circular recess on an inner surface of said lower flange which cooperates with said semi-circular, upper flange opening to form a golf ball pick-up and alignment system.

7. A putter type golf club head including a heel portion, toe portion, rear portion, ball striking face, upper surface and bottom sole wherein the improvement comprises: a longitudinal slot at said rear portion, extending in a heel to toe direction; said slot defining a lower, rearwardly extending flange and an upper, rearwardly extending flange; said upper rearwardly extending flange having a mass substantially greater than the mass of said lower, rearwardly extending flange; said upper flange having a semi-circular opening centrally located thereon, between and separating said heel portion and said toe portion, whereby the center of mass of said club head is located toward said upper surface and said heel and toe portions of said club head and further including a hosel and a recess on said heel portion of said upper, rearwardly extending flange, adjacent said hosel.

* * * * *